United States Patent [19]

Serio, Jr. et al.

[11] 3,991,878

[45] Nov. 16, 1976

[54] ROLL END SUPPORT STRUCTURE AND DISPENSING CARTON

[75] Inventors: Vincent J. Serio, Jr.; John H. Fox, Jr.; James P. Martin, all of Richmond, Va.

[73] Assignee: Reynolds Metals Company, Richmond, Va.

[22] Filed: May 6, 1975

[21] Appl. No.: 574,930

[52] U.S. Cl. ..... 242/55.53; 206/408

[51] Int. Cl.[2] ..... B65H 19/00; B65D 85/67

[58] Field of Search ..... 242/55.53, 55.54, 55.2; 206/408

[56] References Cited

UNITED STATES PATENTS

| | | | |
|---|---|---|---|
| 1,992,077 | 2/1935 | LaRock | 242/55.2 |
| 2,905,404 | 9/1959 | Simmons | 242/55.2 |
| 3,228,519 | 1/1966 | Dong et al. | 242/55.53 |
| 3,260,362 | 7/1966 | Schwinne | 206/408 X |
| 3,338,399 | 8/1967 | Burt | 206/395 |
| 3,352,410 | 11/1967 | Salladay | 206/408 |

*Primary Examiner*—Leonard Summer

*Attorney, Agent, or Firm*—Glenn, Lyne, Gibbs & Clark

[57] ABSTRACT

A roll end support for a dispensing carton for sheet material and carton produced therefrom. A dispenser roll having sheet material wound on a hollow core is disposed within a carton and is supported by a pair of support assemblies located at opposite ends of the core. Each support assembly includes a first support member having a polygonal base corresponding substantially in size and shape to the polygonal ends of its receiving carton and further having a cylindrical body portion. A second support member has a cylindrical body portion rotatably received on the cylindrical body portion of the first support member. The two support members are locked to prevent axial separation and the second support member is inserted into the hollow core of the dispenser roll to permit rotary dispensing of the sheet material.

9 Claims, 4 Drawing Figures

Fig. 1
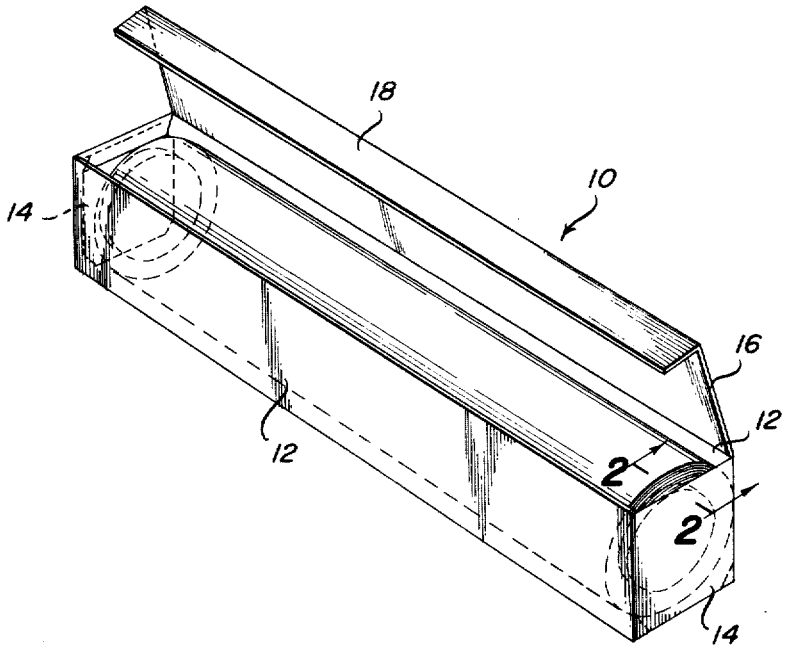
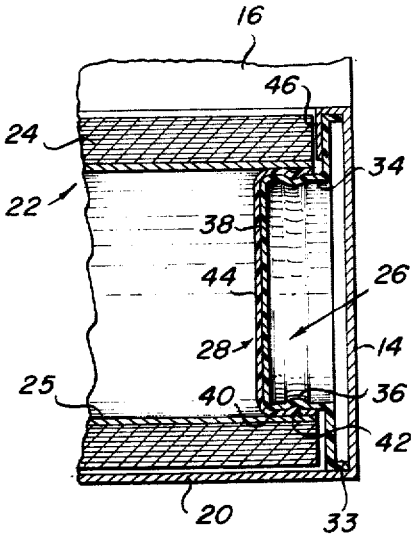
Fig. 2
Fig. 3
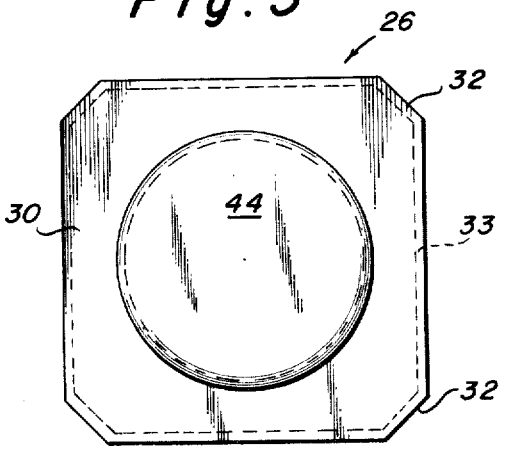
Fig. 4
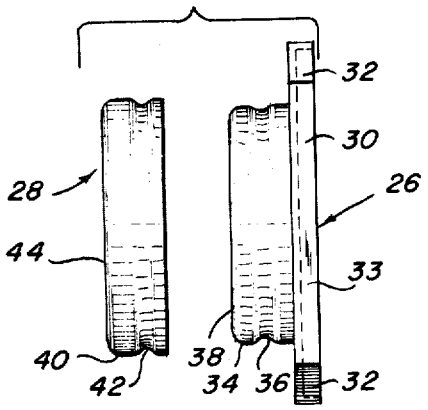

ROLL END SUPPORT STRUCTURE AND DISPENSING CARTON

Heretofore, it has been customary to insert a roll of sheet material into a carton and to dispense the material by pulling on the end of the sheet in order to overcome the friction between the sheet material and the carton. A cutting edge is frequently attached to the carton whereby the sheet material may be severed after a desired amount has been withdrawn from the carton. The unwind of the material from the roll has frequently been non-uniform because of the varying positions that the roll takes within the carton and the decreasing size of the roll as more and more of the material has been dispensed.

Other problems associated with the handling of dispensers for sheet material include damage to both the roll and core during handling and shipping. For example, if one of the typically known dispensers is dropped on its end during handling and shipping, the sheet material frequently telescopes beyond the end of the core making dispensing difficult. The sheet material and/or the core itself may be damaged when the dispenser is dropped which may also make dispensing more difficult as well as marring the appearance of the product.

In accordance with the present invention, the foregoing disadvantages and shortcomings are effectively overcome in that the core for the sheet material is maintained in a fixed position with respect to the panels of the carton regardless of the amount of sheet material which remains to be dispensed. In addition, this stability and ease of dispensing is obtained without any difficult or expensive attachment of the core support members to the end flaps of the carton. Finally, the core support members provide means for preventing any substantial telescoping of the sheet material beyond the ends of the hollow core member during handling and shipping as well as damage to the core ends if the dispenser is inadvertently dropped on its end.

The foregoing worthwhile improvements are effected by providing a core structure for insertion into the hollow core of a dispensing roll for sheet material disposed within a carton having polygonal ends. The core structure includes a first support member having a polygonal base corresponding substantially in size and shape to the polygonal ends of the carton and a cylindrical body portion whereas a second support member has a cylindrical body portion rotatably received on the cylindrical body portion of the first support member. The two support members have interengaging locking means to substantially prevent axial movement in two directions or axial removal of one support member from the other with one of the support members being inserted into the hollow core of the dispenser roll to permit rotary dispensing of the sheet material.

The inherent advantages and improvements of the present invention will become more readily apparent upon considering the following detailed description of the invention and by reference to the drawings in which:

FIG. 1 is a perspective view illustrating a dispensing carton made in accordance with the present invention;

FIG. 2 is a fragmentary elevational view, drawn to an enlarged scale, as viewed along line 2—2 of FIG. 1;

FIG. 3 is a top plan view of the assembled roll end support members of the present invention; and, FIG. 4 is an end elevational view of the end support member of FIG. 3 prior to be assembled with a second end support member.

Referring now more particularly to FIG. 1, a dispensing carton is indicated generally at 10 having front and rear rectangular panels 12 and rectangular end panels 14. The invention is applicable to cartons having polygonal ends generally, including triangular cartons, although most cartons have rectangular ends as is depicted in FIG. 1.

The dispensing carton 10 has a top flap 16 and a top tuck-in flap 18 hingedly secured in conventional manner to rear panel 12. A bottom panel 20 is illustrated in FIG. 2 along with a cross-section of the dispensing roll, indicated generally at 22, which comprises sheet material 24 wound on a hollow core 25. The sheet material may comprise any material such as aluminum foil, plastic or paper. A conventional cutter, not shown, may be attached to the carton to facilitate dispensing a desired amount of sheet material. The hollow core 25 is customarily made of paperboard material which is susceptible of being damaged if dropped on its end.

The roll end support structure of the present invention which supports the hollow core 25 comprises a first support member 26 seen in top plan view in FIG. 3 and in vertical elevation in FIG. 4 together with a second support member, indicated generally at 28 in FIGS. 2 and 4. The first support member 26 consists of a substantially rectangular base 30 for use with a rectangular carton 10 with the base 30 being provided with chamfered ends 32 to facilitate ease of insertion into the carton. Preferably, base 30 has a shallow, downturned peripheral flange 33 which prevents end cutting of the carton and results in a more even distribution of the forces exerted on end panels 14 by base 30. The support member 26 has a cylindrical body portion 34 provided with a circumferentially extending groove 36. Optionally, support member 26 has an end closure 38 whereby the support member 38 may be formed from a single piece of material, preferably polystyrene. If the material is thick enough, it is possible to dispense with the end 38.

The second support member 28, as seen best in FIG. 4, comprises a substantially cup-shaped member having a cylindrical body portion 40 and a circumferentially extending inward bead or groove 42 which mates with the circumferentially extending groove 36 when the two support members are assembled together in telescoping relationship in the position illustrated in FIGS. 2 and 3. The respective grooves 36 and 42 in the first and second support members comprise locking means to prevent axial removal of the second support member from the first support member when assembled in the position shown in FIG. 2. The second support member 28 has an end 44 whereby the second support member may also be formed from a single sheet of plastic material, preferably polystyrene.

The second support member 28 may also be formed without end 44 if the material is sufficiently thick enough. As a further optional feature, the carton itself may be provided with an end flap 46 which overlaps a portion of the rectangular base 30 of the first support member. However, the first support member 26 is intended to have a polygonal base 30 which corresponds substantially in size and shape to the polygonal end of carton 10 whereby no additional retaining means need be employed.

As illustrated in FIG. 2, after the first and second support members are telescoped together so that the second support member 28 is rotatably received on a cylindrical body portion 34 of the first support member 26 and locked thereon by means of interengaging grooves 42 and 36, the two support members are inserted into an end of the container 10. A similar assemblage of first and second support members is inserted into the left-hand end of the hollow core 25. The second support member 28 is sized to permit frictional pressfit engagement of the cylindrical body portion 40 with the inside of the hollow core 25 when the assemblage is inserted into the hollow core of the dispenser roll in order to permit dispensing of the sheet material.

With an assembly of first and second support members in each end of the hollow core material 25, and when inserted into the carton 10, the material may be dispensed merely by pulling the free end of the material and severing it in conventional fashion on a suitable cutting element provided on the carton, not shown. Since the core material rides upon the freely rotatable second support member 28 which is press fitted within the hollow core 25, the sheet material does not constantly engage the bottom of the carton so as to interfere with the dispensing of the sheet material. Also, as can be seen from the FIG. 2 illustration, it is not possible for the sheet material to telescope substantially beyond the end of the core 25 because of the presence of the substantially rectangular base 30 of the first support members 26.

While presently preferred embodiments of the invention have been illustrated and described, it will be recognized that the invention may be otherwise variously embodied and practiced within the scope of the claims which follow.

What is claimed is:

1. A support structure for insertion into the hollow core of a dispenser roll for sheet material disposed within a carton having polygonal ends which comprises:

a. a first support member having a polygonal base corresponding substantially in size and shape to the polygonal ends of said carton and a cylindrical body portion, b. a second support member having a cylindrical body portion rotatably received on said cylindrical body portion of said first support member, c. said first and second support members having interengaging locking means to substantially prevent axial movement in two directions of said second support member with respect to said first support member, and d. said cylindrical body portion of said second support member being sized to permit frictional engagement of said cylindrical body portion when inserted into the hollow core of said dispenser roll to permit dispensing of said sheet material.

2. A support structure for insertion into the hollow core of a dispenser roll as defined in claim 1 wherein said interengaging locking means comprises a circumferentially extending groove on the cylindrical body portion of said first support member and a cooperating bead on the cylindrical body portion of said second support member.

3. A support structure for insertion into the hollow core of a dispenser roll as defined in claim 1 wherein said carton is rectangular and said polygonal base on said first support member is substantially rectangular.

4. A support structure for insertion into the hollow core of a dispensing roll as defined in claim 1 wherein said first and second support members are formed from polystyrene.

5. A support structure for insertion into the hollow core of a dispenser roll as defined in claim 1 wherein the base of said first support member is provided with a downturned flange to prevent end cutting of said carton by more evenly distributing the forces exerted by said base against an end of said carton.

6. A dispensing carton for sheet material as defined in claim 5 wherein said first and second support members are formed from polystyrene.

7. A dispensing carton for sheet material comprising:

a. a rectangular paperboard carton, b. a dispenser roll having sheet material wound on a hollow core disposed within said rectangular paperboard carton, said dispenser roll of sheet material being supported by a pair of support assemblies located at opposite ends of the carton with each support assembly comprising:

1. a first support member having a substantially rectangular base corresponding substantially in size and shape to the rectangular ends of said carton and a cylindrical body portion, 2. a second support member having a cylindrical body portion rotatably received on said cylindrical body portion of said first support member, 3. said first and second support members having interengaging locking means to substantially prevent axial movement in two directions of said second support member with respect to said first support member, and 4. said cylindrical body portion of said second support member being inserted into and in frictional engagement with said hollow core of said dispenser roll to permit dispensing of said sheet material.

8. A dispensing carton for sheet material as defined in claim 7 wherein said interengaging locking means comprises a circumferentially extending groove on the cylindrical body portion of said first support member and a cooperating bead on the cylindrical body portion of said second support member.

9. A dispensing carton for sheet material as defined in claim 7 wherein the base of said first support member is provided with a downturned flange to prevent end cutting of said carton by more evenly distributing the forces exerted by said base against an end of said carton.

* * * * *